US007316580B1

(12) United States Patent
Walker

(10) Patent No.: US 7,316,580 B1
(45) Date of Patent: Jan. 8, 2008

(54) METHOD AND APPARATUS FOR FASTENER

(76) Inventor: David G. Walker, 111 E. Lakeshore Dr., Storm Lake, IA (US) 50588-2408

( * ) Notice: Subject to any disclaimer, the term of this patent is extended or adjusted under 35 U.S.C. 154(b) by 80 days.

(21) Appl. No.: 11/206,686

(22) Filed: Aug. 18, 2005

(51) Int. Cl.
*H01R 13/62* (2006.01)

(52) U.S. Cl. ..... 439/369

(58) Field of Classification Search ..... 439/369, 439/371, 367
See application file for complete search history.

(56) References Cited

U.S. PATENT DOCUMENTS

| | | | | |
|---|---|---|---|---|
| 4,869,683 | A * | 9/1989 | Nelson | 439/369 |
| 4,993,409 | A | 2/1991 | Grim | |
| 5,041,000 | A | 8/1991 | Shotey | |
| 5,062,414 | A | 11/1991 | Grim | |
| 5,080,598 | A | 1/1992 | Shotey | |
| 5,170,520 | A | 12/1992 | Milliken | |
| 5,213,147 | A | 5/1993 | Zheng | |
| 5,273,454 | A * | 12/1993 | Shotey | 439/367 |
| 5,334,042 | A | 8/1994 | Chevalier | |
| RE34,883 | E | 3/1995 | Grim | |
| 5,694,654 | A | 12/1997 | Roy | |
| 6,349,904 | B1 | 2/2002 | Polad | |
| 6,997,734 | B1 * | 2/2006 | McQuirter | 439/369 |
| 2004/0065787 | A1 | 4/2004 | Hardt et al. | |

* cited by examiner

*Primary Examiner*—Javaid H. Nasri
(74) *Attorney, Agent, or Firm*—McKee, Voorhees & Sease, P.L.C.

(57) ABSTRACT

A fastener and fastening system for securing electrical plug connections in place is described. The fastener includes a first body having first and second opposite surfaces wherein the first surface of the first body includes a plurality of fastening loops. The fastener also includes a second body also having first and second opposite surfaces. The first surface of the second body includes a plurality of fastening hooks and is operatively connected to the first body so that the first and second surfaces of the first body are substantially parallel to the first and second surfaces of the second body.

9 Claims, 7 Drawing Sheets

METHOD AND APPARATUS FOR FASTENER

BACKGROUND OF THE INVENTION

The present invention relates to a fastener. More specifically, the present invention relates to a fastener that is used to secure connectors together in a manner which prevents the connectors from becoming unconnected. The present invention can be used in numerous contexts. One of the problems addressed by the invention relates to the hanging of electrical cords, such as extension cords. In numerous environments, it is necessary to hang extension cords. In many types of electrical connections, including standard two-prong or three-prong plug and receptacle connections, the connections are susceptible to breaking if the cord is pulled. This can be problematic.

Another related problem is the plugging of an electrical cord into an outlet. For example, a vacuum cleaner can be plugged into an electrical outlet. Sometimes one operates the vacuum at the maximum range permitted by the cord, the cord being pulled taut. Doing so sometimes eliminates the need to unplug the vacuum cleaner and replug it into a different electrical outlet. However, sometimes the vacuum cleaner is inadvertently unplugged in the process. This can sometimes bend the prongs of the plug and is at least a nuisance.

Therefore, it is a primary object, feature, or advantage of the present invention to improve upon the state of the art.

It is a further object, feature, or advantage of the present invention to provide a method for securing an electrical connection in place.

A still further object, feature, or advantage of the present invention is to provide a method for securing an electrical connection in place that is economical.

Another object, feature, or advantage of the present invention to provide a method for securing an electrical connection in place that can be used in different environments, for different types of electrical connections.

One or more of these and/or other objects, features, or advantages of the present invention will become apparent from the specification and claims that follow.

BRIEF SUMMARY OF THE INVENTION

According to one aspect of the present invention a fastener provides for securing an electrical plug connection having a male and a female mating plug connection so that the male and female plug connectors do not become unconnected. The fastener includes a first body having first and second opposite surfaces. The first surface of the first body includes a plurality of fastening loops. There is a second body having first and second opposite surfaces. The first surface of the second body includes a plurality of fastening hooks and is operatively connected to the first body so that the first and second surfaces of the first body are substantially parallel to the first and second surfaces of the second body.

The fastener may also include a first strap operatively connected to the first body having first and second opposite surfaces. The first surface of the first strap preferably has a plurality of fastening hooks. Preferably, there is a second strap operatively connected to the second body which also has first and second opposite surfaces. The first surface of the second strap has fastening loops capable of engaging with the fastening hooks on the first surface of the first strap so that the first and second straps can cooperate to hang the fastener to an external support structure. The first strap is operatively connected to the first body so that the fastening hooks on the first surface of the first strap are engaged with the fastening loops on the first surface of the first body. The second strap is operatively connected to the second body so that the fastening loops on the first surface of the second strap are engaged with the fastening hooks on the first surface of the second body. The first body may be operatively connected to the second along a corner of the first and second bodies.

According to another aspect of the present invention, a fastening system for securing an electrical plug connection having a male and a female mating plug connection so that the male and female plug connectors do not become unconnected is provided. The system includes a first fastener and a second fastener. The first fastener includes a first body having first and second opposite surfaces, the first surface of the first body includes a plurality of fastening loops. The first fastener also includes a second body having first and second opposite surfaces where the first surface of the second body includes fastening hooks and is operatively connected to the first body. The operative connection forms an inlet between the first and second bodies that is adapted for allowing an electrical cord to pass between the first and second bodies while retaining an electrical connector plug between the first and second bodies, the connector plug being connected to the electrical cord. The second fastener includes a first body having first and second opposite surfaces. The first surface of the first body includes a plurality of fastening loops. The second body has first and second opposite surfaces. The first surface of the second body includes a plurality of fastening hooks and is operatively connected to the first body. The operative connection forms an inlet between the first and second bodies that is adapted for allowing an electrical cord to pass between the first and second bodies while retaining an electrical connector end between the first and second bodies, the connector end being connected to the electrical cord.

The system may include a first operative connection between the first body of the first fastener and the second body of the second fastener wherein the plurality of fastening loops on the first body of the first fastener are engaged with the plurality of fastening hooks on the second body of the second fastener. The system may also include a second operative connection between the second body of the first fastener and the first body of the second fastener wherein the plurality of fastening hooks on the second body of the first fastener are engaged with the plurality of fastening loops on the first body of the second fastener. The first and second operative connections in combination with the inlets between the first and second bodies of the first and second fasteners cooperate to secure and hold an electrical connection formed between the connector ends of an electrical cord that are retained between the bodies of the fasteners. The fastening system may include straps for hanging the fastening system to an external structure.

According to another aspect of the present invention, a fastening system for securing a plug to an electrical receptacle so that the plug will not become disconnected from the receptacle is provided. The fastening system includes an electrical receptacle having a protective plate around the receptacle that is fastened to the receptacle and a hook and loop fastener held between the receptacle and the protective plate having first and second opposite surfaces with a plurality of fastening hooks on the first surface and a plurality of fastening loops on the second surface. The hook and loop fastener has first and second opposite ends that protrude from opposite sides of the protective plate so that the opposite ends can be wrapped around an electrical plug that is inserted into the receptacle. The plurality of fastening hooks on the first surface and the plurality of fastening loops on the second surface are capable of engaging in order to hold the electrical plug in the receptacle.

DETAILED DESCRIPTION OF THE PREFERRED EMBODIMENT

The present invention will be described as it applies to its preferred embodiment. It is not intended that the present invention be limited to the described embodiments. It is intended that the invention cover all modifications and alternatives which may be included within the spirit and scope of the invention.

Throughout the drawings, hooks (18, 32, 96) are represented by a pattern of dashes and loops (22, 40, 98) are represented by a pattern of small circles. These hook and loop fasteners are commonly known as Velcro®.

Figure 1:
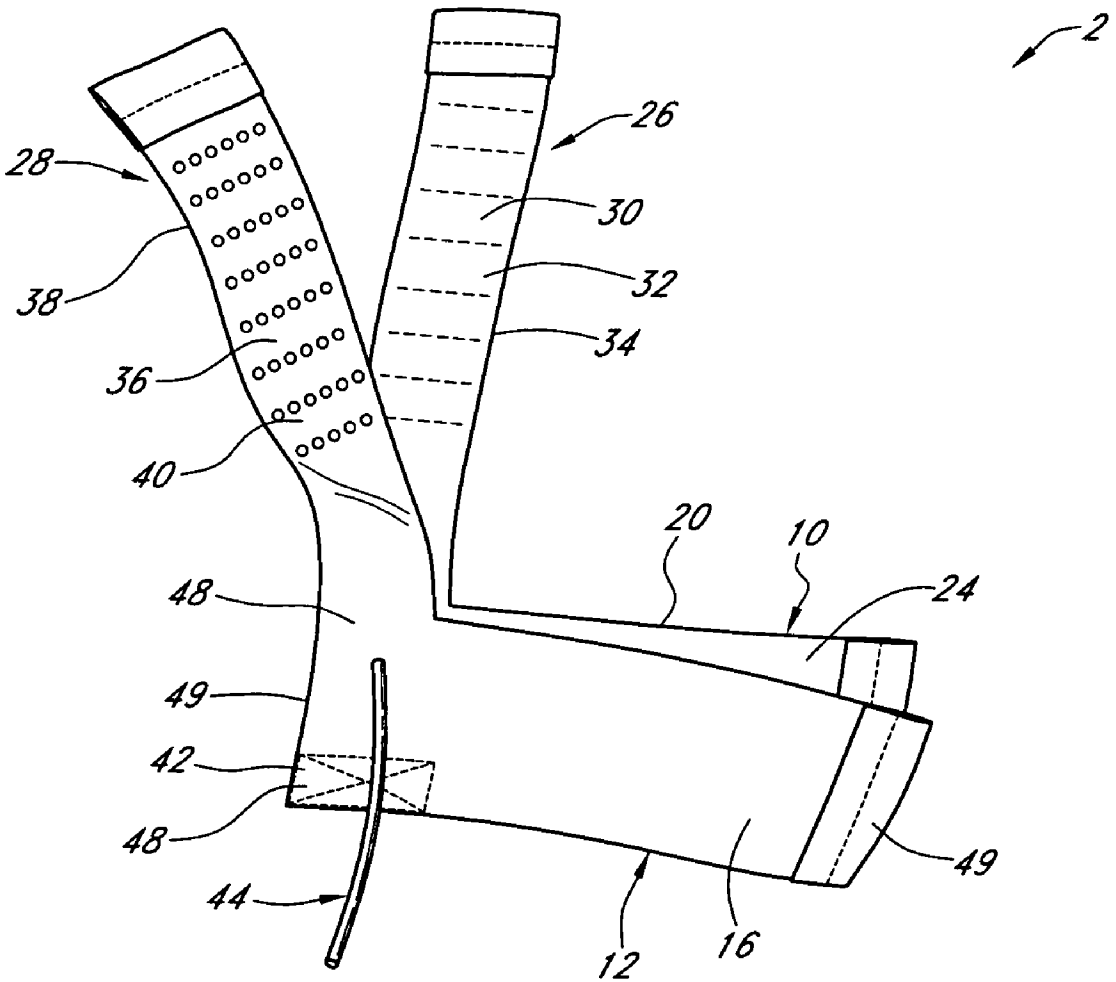
FIG. 1 is a view of a fastener for securing an electrical plug connection according to one embodiment of the present invention.
Figure 2:
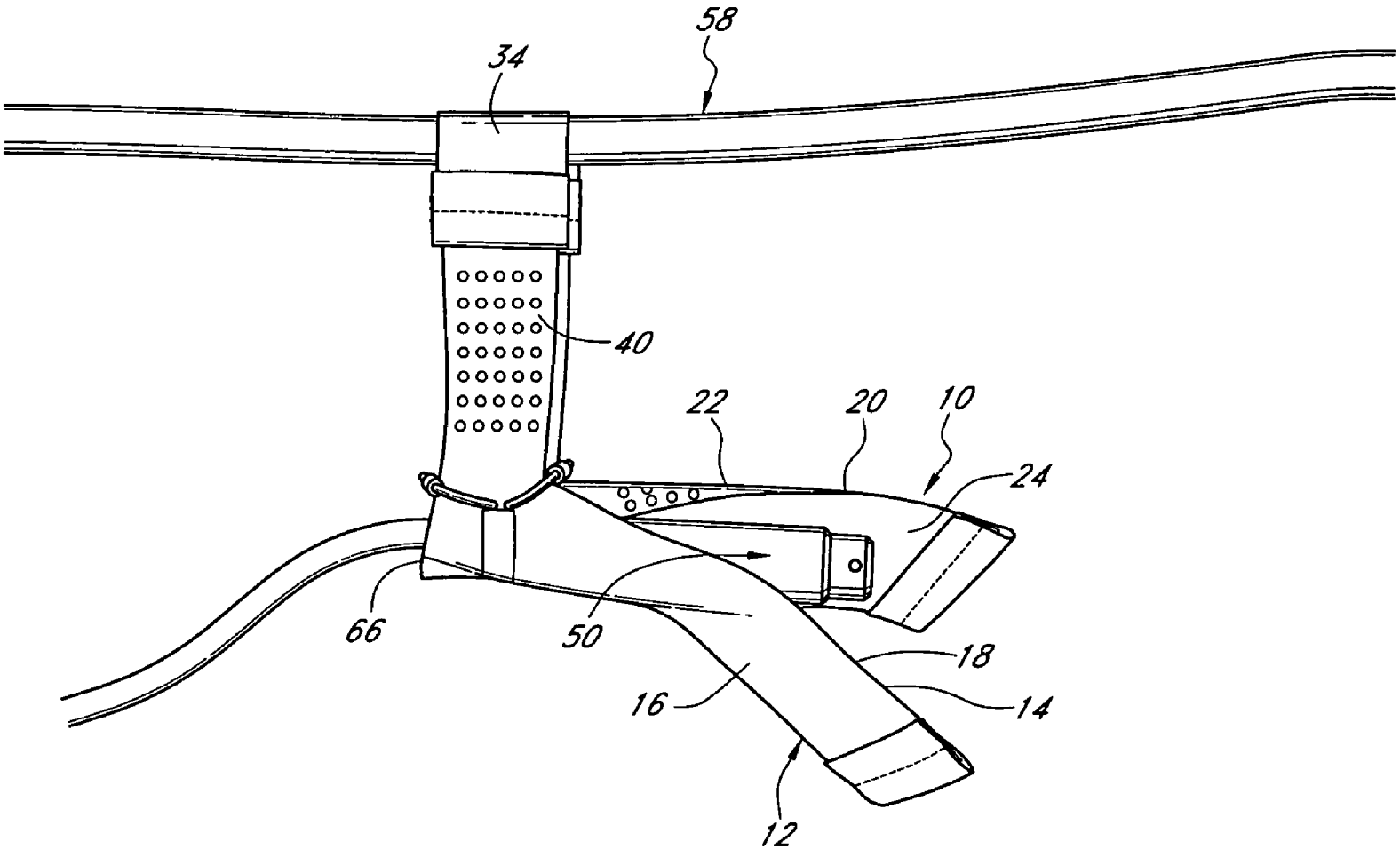
FIG. 2 is a perspective view of the fastener of FIG. 1 with a plug in place according to one embodiment of the present invention.
Figure 4:
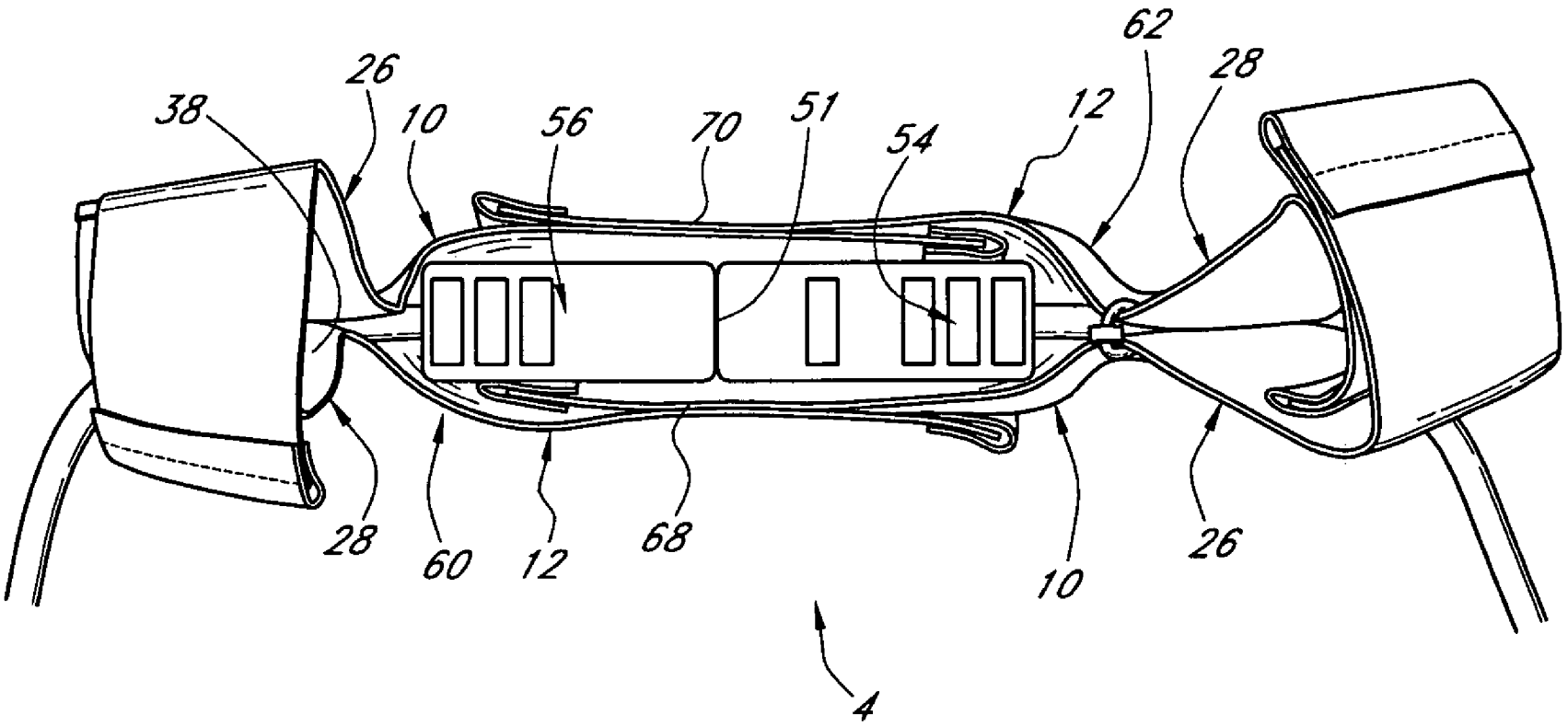
FIG. 4 is another view of a fastening system holding an electrical connection in place according to one embodiment of the present invention.

FIGS. 1 and 2 show a fastener 2 for securing an electrical plug connection 51 (FIG. 4). The fastener 2 has a first body 10. The first body 10 has first and second opposite surfaces, 20 and 24. A plurality of fastening loops 22 are attached to the first surface 20 of the first body 10.

The fastener 2 has a second body 12. The second body 12 has first and second opposite surfaces, 14 and 16. The second body 12 is operatively connected to the first body 10 so that the first and second surfaces, 20 and 24, of the first body 10 are substantially parallel to the first and second surfaces, 14 and 16, of the second body 12. The operative connection can be formed using materials and/or methods well-known in the art, including, but not limited to, zip ties 44, thread 42, glue, hook and loop fastening, ultrasonic or frictional welding, or even a single piece manufacturing of the first and second bodies, 10 and 12. Preferably, the operative connection can be made near a corner 48 of the bodies. A plurality of fastening hooks 18 are attached to the first surface 14 of the second body 12.

The fastener 2 can include first and second straps, 26 and 28, for hanging the fastener 2 to an external support structure 58, such as a cable, beam, truss, pipe, bar, or any other structure to which the user wants to hang the fastener 2. The first strap 26 has first and second opposite surfaces, 30 and 34. A plurality of fastening hooks 32 are attached to the first surface 30 of the first strap 26. The second strap also has first and second opposite surfaces, 36 and 38. A plurality of fastening loops 40 are attached to the first surface 36 of the second strap 28. The first and second straps, 26 and 28, can be operatively connected to the first and second bodies, 10 and 12, preferably near one of the ends 49, using the same well-known materials and/or methods listed for connecting the first and second bodies, 10 and 12. The plurality of fastening loops 40 on the second strap 28 are capable of engaging with the plurality of fastening hooks 32 on the first strap 26 so that by mating the two straps together, the user can hang the fastener 2 to an external support structure such as one of those listed above.

The first and second bodies, 10 and 12, and the first and second straps, 26 and 28, can be made of materials well-known in the art, such as nylon, and can be easily purchased. The plurality of fastening loops (22 and 40) and hooks (18 and 32) are commonly known as Velcro® and can be readily purchased.

Figure 3:
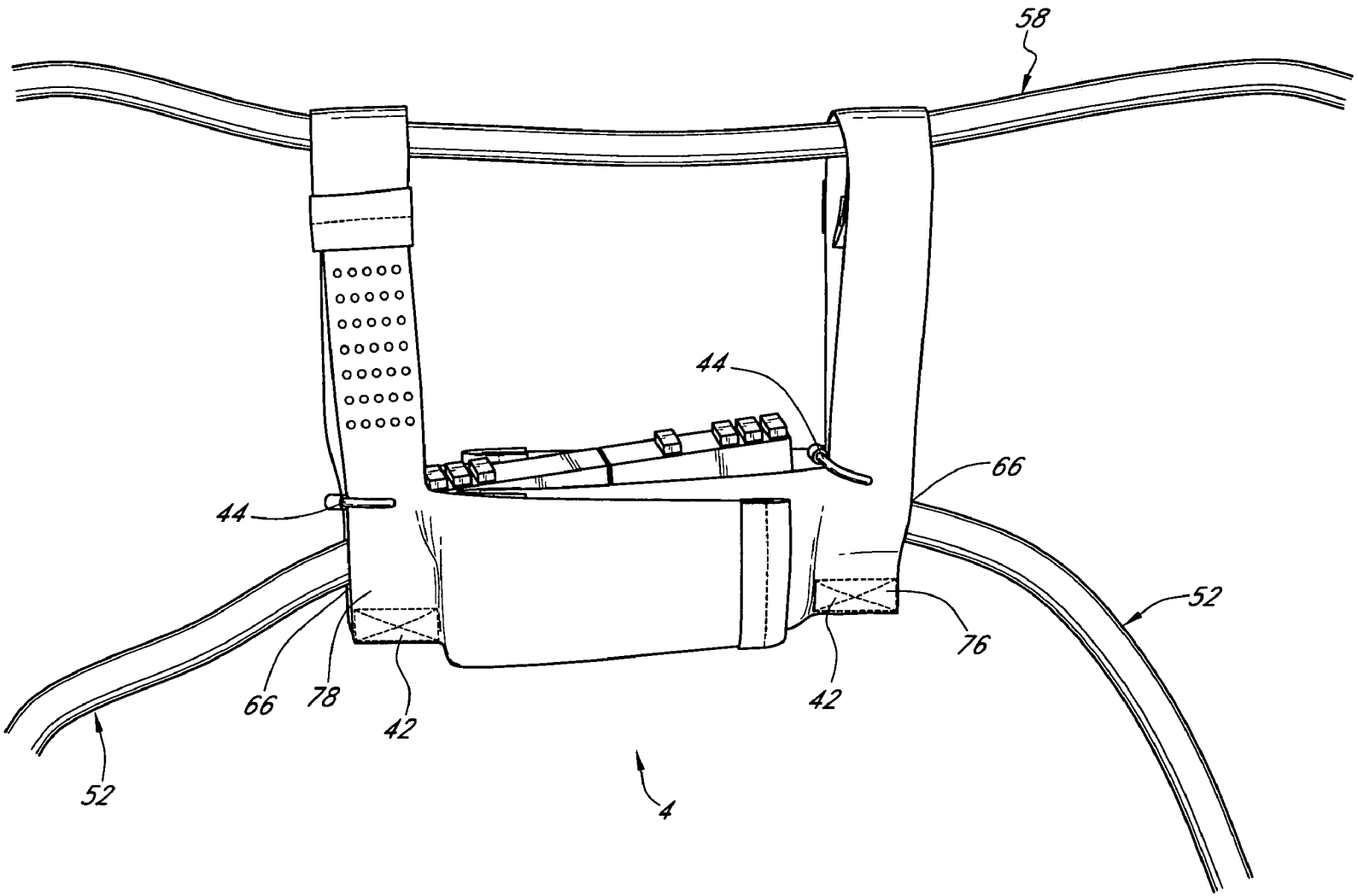
FIG. 3 is a perspective view of a fastening system holding an electrical connection in place according to one embodiment of the present invention.

FIGS. 3 and 4 show an example of a fastening system 4 using two fasteners 2 for securing an electrical plug connection 51 that has a male plug connector 54 and a female plug connector 56. The connectors, 54 and 56, are in electrical communication with an electrical cord 52.

First and second fasteners, 60 and 62, are similar to the fastener 2 described above. The first and second bodies, 10 and 12, of the first and second fasteners, 60 and 62, are operatively connected so that an inlet 66 is formed between the first and second bodies, 10 and 12. The inlet 66 is adapted for allowing the cord 52 to pass between the first and second bodies, 10 and 12, but retains the connector, 54 or 56, between the first and second bodies, 10 and 12. Thus, if a user yanks on the cord 52, the inlet 66 will retain the plug connector (54 or 56) between the first and second bodies, 10 and 12.

The fastening system 4 can be used to prevent the electrical plug connection 51 from becoming disconnected by forming operative connections, 68 and 70, between the first and second fasteners, 60 and 62. The operative connections, 68 and 70, are formed by pulling the first and second bodies, 10 and 12, around the electrical plug connection 51 and pressing the plurality of fastening loops 22 on the first body 10 of each fastener (60 and 62) against the plurality of fastening hooks 18 on the second body 12 of each fastener (60 and 62). The combination of the operative connections, 68 and 70, along with the inlets 66 cooperate to secure, hold, and maintain the electrical plug connection 51. This combination prevents the electrical plug connection 51 from becoming disconnected when an external force pulls on the cord 52.

The fastening system 4 can include first and second straps, 26 and 28 (previously described), operatively connected to the first and second bodies, 10 and 12, of the first and second fasteners, 60 and 62, for hanging the fastening system 4 to external support structures, such as those previously listed. Preferably, the first and second straps, 26 and 28, are operatively connected near the ends of the fasteners, 60 and 62.

The fastening system 4 can be used to secure many types of electrical connections. Examples include, but are not limited to, 120-volt male-to-female prong connections (as shown in FIGS. 3 and 4) such as extension cord connections, electrical audio plug connectors (such as 50 in FIG. 2), or in-line phone plug connections.

Figure 5:
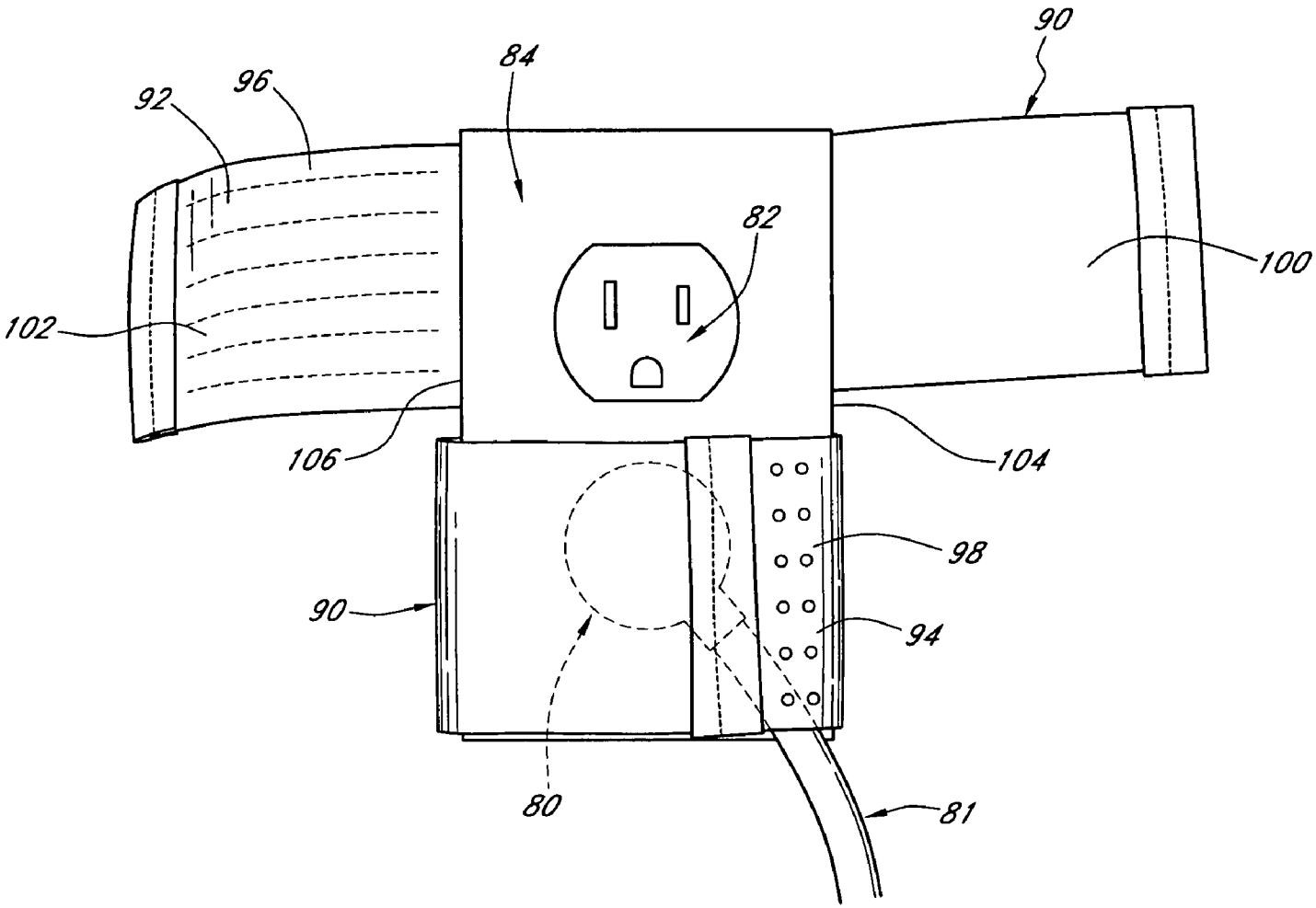
FIG. 5 is a view of one embodiment of a fastening system of the present invention for holding an electrical plug in an outlet.
Figure 6:
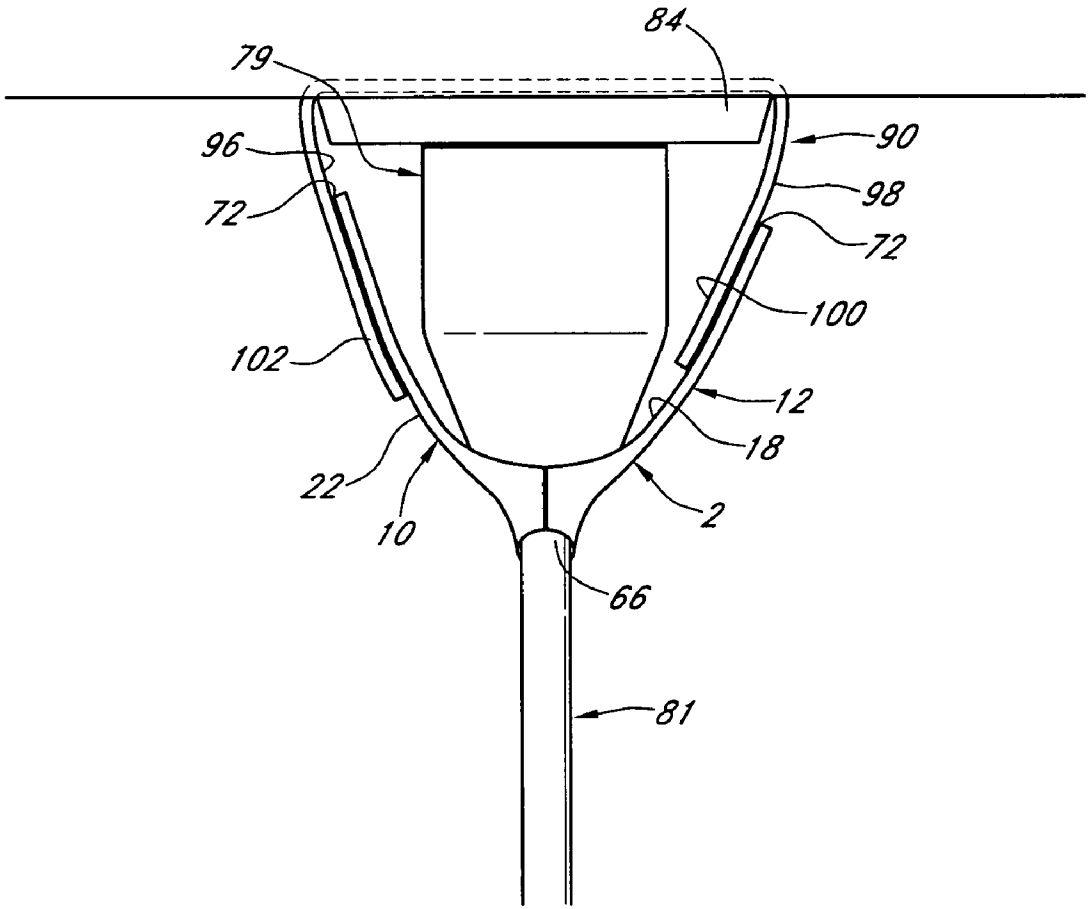
FIG. 6 is a view of another embodiment of a fastening system of the present invention for holding an electrical plug in an outlet.

As shown in FIGS. 5 and 6, the present invention can also be used to secure an electrical plug, such as 79 (FIG. 6) or 80 (FIG. 5), to an electrical receptacle 82 so that the plug 80 will not become disconnected from the receptacle 82 if an external force pulls on a cord 81 that is connected to the plug 80. During normal operation, a protective plate 84 is fastened to the electrical receptacle 82. The present invention uses a hook and loop fastener 90 that has first and second opposite surfaces, 92 and 94. A plurality of fastening hooks 96 are attached to the first surface 92. A plurality of fastening loops 98 are attached to the second surface 94. The hook and loop fastener 90 is firmly held between the protective plate 84 and the receptacle 82 by placing the hook and loop fastener 90 between the protective plate 84 and the receptacle 82 and then fastening the protective plate 84 to the receptacle 82 using means well-known in the art, such as with a screw.

The hook and loop fastener 90 has first and second opposite ends, 100 and 102, that protrude from opposite sides, 104 and 106, of the protective plate 84. The opposite ends, 100 and 102, can be wrapped around the electrical plug 80 that is inserted into the receptacle 82. When the opposite ends, 100 and 102, are wrapped around the electrical plug 80 and are pressed together, the plurality of fastening hooks 96 on the first surface 92 engage with the plurality of fastening loops 98 on the second surface 94 in order to prevent the plug 80 from becoming disconnected from the receptacle 82 when an external force pulls on the cord 81.

FIG. 6 shows an electrical plug 79 in which the cord 81 protrudes straight out of the end of the plug. In order to fasten this type of plug 79 into the receptacle 82, a fastener 2 (previously described) can be used in combination with the hook and loop fastener 90. An operative connection 72 is made between the fastening hooks 96 on the first surface 92 of the hook and loop fastener 90 and the fastening loops 22 on the first body 10 of the fastener 2. Another operative connection 72 is made between the fastening loops 98 on the second surface 94 of the hook and loop fastener 90 and the fastening hooks 18 on the second body 12 of the fastener 2. The fastener 2 forms inlet 66 (previously described) which allows the cord 81 to pass through but retains the plug 79. When the plug 79 is plugged into a receptacle, such as 82, the fastener 2, hook and loop fastener 90, and the operative connections 72 formed between the two fasteners cooperate to hold the plug 79 into the receptacle 82, even when an external force pulls on cord 81.

Figure 7:
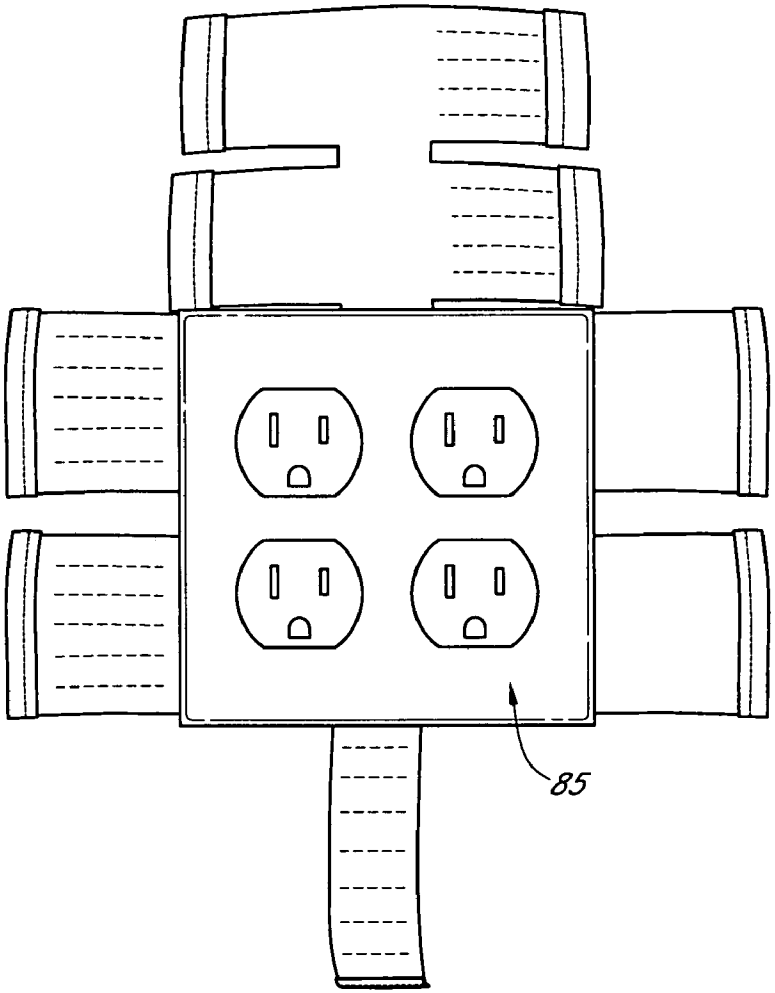
FIG. 7 is a view of one embodiment of a fastening system of the present invention for holding an electrical plug in a double gang outlet.

The hook and loop fastener 90 is commonly known as a piece of Velcro® and can be readily purchased. Likewise, electrical receptacles and protective plates are well-known in the art and easily purchasable. The protective plate can be a single gang plate (such as protective plate 82), or a double gang plate (such as protective plate 85 in FIG. 7). The invention can be adapted to any other type of receptacle or protective plate and receptacles and protective plates of various shapes, configurations, and sizes. A plurality of hook and loop fasteners can be used to hold one or more plugs into one or more receptacles.

A general description of the present invention as well as a preferred embodiment of the present invention has been set forth above. Those skilled in the art to which the present invention pertains will recognize and be able to practice additional variations in the methods and systems described which fall within the teachings of this invention. Accordingly, all such modifications and additions are deemed to be within the scope of the invention which is to be limited only by the following claims.

What is claimed is:

1. A fastener for securing an electrical plug connection having a male and a female mating plug connection so that the male and female plug connectors do not become unconnected, the fastener comprising:

a first body having first and second opposite surfaces;

the first surface of the first body comprising a plurality of fastening loops;

a second body having first and second opposite surfaces;

the first surface of the second body comprising a plurality of fastening hooks and is operatively connected to the first body so that the first and second surfaces of the first body are substantially parallel to the first and second surfaces of the second body;

a first strap operatively connected to the first body having first and second opposite surfaces;

the first surface of the first strap having a plurality of fastening hooks;

a second strap operatively connected to the second body having first and second opposite surfaces;

the first surface of the second strap having a plurality of fastening loops capable of engaging with the plurality of fastening hooks on the first surface of the first strap so that the first and second straps can cooperate to hang the fastener to an external support structure.

2. The fastener of claim 1 wherein the first strap is operatively connected to the first body so that the fastening hooks on the first surface of the first strap are engaged with the fastening loops on the first surface of the first body.

3. The fastener of claim 2 wherein the second strap is operatively connected to the second body so that the fastening loops on the first surface of the second strap are engaged with the fastening hooks on the first surface of the second body.

4. The fastener of claim 1 wherein the first body is operatively connected to the second body along a corner of the first and second bodies.

5. A fastening system for securing an electrical plug connection having a male and a female mating plug connection so that the male and female plug connectors do not become unconnected, the fastening system comprising:

a first fastener comprising;

a first body having first and second opposite surfaces;

the first surface of the first body comprising a plurality of fastening loops;

a second body having first and second opposite surfaces;

the first surface of the second body comprising a plurality of fastening hooks and is operatively connected to the first body;

the operative connection forming an inlet between the first and second bodies that is adapted for allowing an electrical cord to pass between the first and second bodies while retaining an electrical connector plug between the first and second bodies, the connector plug being connected to the electrical cord;

a second fastener comprising;

a first body having first and second opposite surfaces;

the first surface of the first body comprising a plurality of fastening loops; a second body having first and second opposite surfaces; the first surface of the second body comprising a plurality of fastening hooks and is operatively connected to the first body;

the operative connection forming an inlet between the first and second bodies that is adapted for allowing an electrical cord to pass between the first and second bodies while retaining an electrical connector end between the first and second bodies, the connector end being connected to the electrical cord;

a first operative connection between the first body of the first fastener and the second body of the second fastener wherein the plurality of fastening loops on the first body of the first fastener are engaged with the plurality of fastening hooks on the second body of the second fastener;

a second operative connection between the second body of the first fastener and the first body of the second fastener wherein the plurality of fastening hooks on the second body of the first fastener are engaged with the plurality of fastening loops on the first body of the second fastener;

whereby the first and second operative connections in combination with the inlets between the first and second bodies of the first and second fasteners cooperate to secure and hold an electrical connection formed between the connector ends of an electrical cord that are retained between the bodies of the fasteners.

6. The fastening system of claim 5 further comprising:

a plurality of straps operatively connected to the first and second fasteners for hanging the fastening system to an external structure.

7. The fastening system of claim 6 wherein:

the plurality of straps comprises a first strap having first and second opposite surfaces, the first surface of the first strap having a plurality of fastening hooks;

the plurality of straps comprising a second strap having first and second opposite surfaces;

the first surface of the second strap having a plurality of fastening loops capable of engaging with the plurality of fastening hooks on the first surface of the first strap so that the first and second straps can cooperate to hang the fastening system to the external structure.

8. The fastening system of claim 7 wherein:

the first and second straps are operatively connected to the first fastener along an end of the first fastener.

9. The fastening system of claim 7 wherein:

the first and second straps are operatively connected to the second fastener along an end of the second fastener.

* * * * *